US008001903B1

(12) United States Patent
Quintana et al.

(10) Patent No.: US 8,001,903 B1
(45) Date of Patent: Aug. 23, 2011

(54) LIQUID MIST TRACER FOR SHOTGUN AMMUNITION

(76) Inventors: Mauricio F. Quintana, Glastonbury, CT (US); James Alfred Dunnam, Austin, TX (US)

( * ) Notice: Subject to any disclaimer, the term of this patent is extended or adjusted under 35 U.S.C. 154(b) by 0 days.

(21) Appl. No.: 13/066,417

(22) Filed: Apr. 14, 2011

Related U.S. Application Data

(63) Continuation-in-part of application No. 11/899,317, filed on Sep. 5, 2007, now Pat. No. 7,926,424.

(51) Int. Cl.
*F42B 7/02* (2006.01)

(52) U.S. Cl. ..... 102/458; 102/370

(58) Field of Classification Search ..... 102/367, 102/369, 370, 448, 458, 513, 502, 529
See application file for complete search history.

(56) References Cited

U.S. PATENT DOCUMENTS

| | | | | |
|---|---|---|---|---|
| 2,963,975 | A * | 12/1960 | Musser | 102/370 |
| 4,195,572 | A * | 4/1980 | Knapp | 102/367 |
| 7,610,857 | B1 * | 11/2009 | Dunnam et al. | 102/458 |
| 7,926,424 | B1 * | 4/2011 | Quintana et al. | 102/458 |
| 2010/0175577 | A1 * | 7/2010 | Ladyjensky | 102/513 |

* cited by examiner

*Primary Examiner* — Michael Carone
*Assistant Examiner* — Daniel Troy
(74) *Attorney, Agent, or Firm* — Mary J. Gaskin

(57) ABSTRACT

A tracer cylinder for use with a shotgun shell to provide an aiming and training aid for shotgun shooting sports, which also can be used for military and police applications. The tracer cylinder, which contains a liquid, is positioned in a shotgun shell above a disk-shaped piercing valve. The shell is loaded into a shotgun and fired. The forces of ignition cause the point on the piercing valve to puncture the bottom of the cylinder, and, when the cylinder is airborne, tracer liquid is released through the resulting opening by physical forces, creating a long-lasting mist or fog cloud that is visible to the shooter. The shooter is provided with a consistent and durable reference, allowing him or her to make effective corrections to his or her shooting technique. The tracer cylinder can be loaded into a shot holder, with or without shot pellets.

15 Claims, 7 Drawing Sheets

LIQUID MIST TRACER FOR SHOTGUN AMMUNITION

FIELD OF INVENTION

This application is a continuation in part of application Ser. No. 11/899,317, which was filed on Sep. 5, 2007. This invention relates to shotgun ammunition, more specifically to tracers used to make the shot visible to shooters. This invention serves as a training aid to improve one's shooting ability for shotgun sports such as Trap, Skeet or Sporting Clays. It also serves as a shotgun aiming and training aid for hunters, with applications for military and police personnel.

BACKGROUND OF THE INVENTION

All shotgun sports require the shooter to accurately predict the trajectory of the target. Mastering the lead is the greatest challenge in shotgunning sports. The lead is defined as the distance in front of the moving target, which the shooter aims and shoots at in order to break the target. The particular lead will vary, depending on the application, shot type, shot speed, shooter's technique, speed and angle of the target, and atmospheric conditions; it can range from a few inches to more than ten feet.

The visibility of an object to the human eye generally depends on the size of the object, the relative distance between the object and the observer, the relative speed of the object, the color of the object, and the light intensity and atmospheric conditions. The human brain and eye refresh images approximately every 0.1 seconds, while the average shot flight time to the target ranges from approximately 0.05 to 0.3 seconds; this makes shooting moving objects a real challenge.

Inventors have developed tracers for shotgun shells in an attempt to aid the shooter in visualizing his or her shot with regard to the target. Prior inventions can be categorized as non-ignition and ignition type tracers. Each type has its limitations, including the risk of fire with pyrotechnic tracers and the complexity of manufacturing in the case of chemiluminescent tracers. Both types share a significant drawback: the fact that the shooter has a mere fraction of the second to see the tracer. This makes current inventions of limited value to shooters in providing a consistent and visible reference to aid them in correcting their shooting.

The prior art includes the following inventions:

1. Shot-Shell (U.S. Pat. No. 1,304,962 to J. Gravely in 1919);
2. Shotgun Shell (U.S. Pat. No. 1,457,337 to E. Barrows in 1923);
3. Method and Apparatus for Forming Letters and Symbols in the Air (U.S. Pat. No. 1,716,794 to J. Remey, 1929);
4. Shotgun Cartridge (U.S. Pat. No. 1,887,990 to H. Brownsdon in 1932);
5. Artificial Production of Fog (U.S. Pat. No. 1,895,765 to U. Muller in 1933);
6. Method for Creating Aerial Effects (U.S. Pat. No. 2,062,511 to J. Haddock in 1936);
7. Tracer Shotshell (U.S. Pat. No. 3,262,390 to R. Cowles in 1966);
8. Apparatus for Producing Smoke or Fog (U.S. Pat. No. 3,244,641 to D. Durr in 1966);
9. Method and Means for Producing and Controlling the Discharge of Fog (U.S. Pat. No. 3,379,373 to R. Roberts in 1968);
10. Nebulizer (U.S. Pat. No. 3,652,015 to G. Beall in 1972);
11. Shotgun Shell Tracer Wad (U.S. Pat. No. 4,553,481 to V. Ricci in 1984);

12. Method and Apparatus for Sky Typing (U.S. Pat. No. 4,561,201 to G. Sanborn in 1985);
13. Efficient Artificial Smoke Generator (U.S. Pat. No. 4,836,452 to J. Fox in 1989);
14. Aerosol Diffusion Fogger (U.S. Pat. No. 5,057,243 to M. Becker in 1991);
15. Diffusion Fogger (U.S. Pat. No. 4,990,290 to J. Gill in 1991);
16. Tracer Cartridges (U.S. Pat. No. 5,429,054 to R. Topping in 1995);
17. Smoke Generator for Radio Controlled Aircraft (U.S. Pat. No. 5,932,978, to J. Geyer in 1999);
18. Compression Cartridge (U.S. Pat. No. 6,250,228 to F. King in 2003);
19. Shotgun Shell Flight Path Indicator (U.S. Pat. No. 6,539,873 to E. W. Diller in 2003);
20. Ballistic Tracer Platform for Shotgun Ammunition (U.S. Pat. No. 10,656,471 to J. Dunnam and M. Quintana in 2007 and U.S. Pat. No. 7,610,857 to J. Dunnam and M, Quintana in 2009).

An improved design would overcome the drawbacks of the prior art and would fulfill the following criteria:

(a) Provide the shooter with a consistent and accurate reference to the target.
(b) Give the shooter more time to see the tracer with reference to the target; in other words the improved design should have memory.
(c) Be safe to use and environmentally friendly.
(d) Be simple and economical to manufacture.
(e) Be entertaining to the shooter.

SUMMARY OF INVENTION

The present invention provides an innovative design for a tracer that comprises a tracer cylinder that contains a liquid, which utilizes appropriate valves, and which, when loaded into a shotgun shell and fired, has the means to release the liquid and emit a thick and long-lasting mist or fog cloud that provides the shooter with a consistent and durable reference, allowing him or her to make effective corrections to his or her shooting technique. The invention uses any one of a variety of liquid compounds, such as a vegetable oil (like olive oil), mineral oil, synthetic oil, paints, water, aqueous gels, and known fogging liquids such as titanium tetrachloride ($TiCl_4$). When water or an aqueous gel is used, various dyes, pigments, and/or reflective particles are added in order to make the fog cloud more visible to the shooter. This invention can be modified and can be used with all shot types and in many shotgun gauges, including 8, 10, 12, 16, 20, 28 and 410.

In accordance with the present invention, the tracer comprises a cylinder with a length equal to or larger than its diameter, thereby ensuring its accuracy. Holding the liquid of choice, the cylinder is loaded into a typical shotgun shell, strategically located in front of the shot pellets in order to minimize the structural stresses on the cylinder resulting from ignition of the propellant. Alternatively, it can be loaded into the shot holder of a wad, with no shot pellets. In either case, the shot cup petals protect it during firing and acceleration of the wad and cylinder down the barrel. The cylinder can be sized to have different internal and exterior diameters and length combinations in order to adjust the volume of liquid, depending on the shotgun gauge with which it is used and other variables, such as the distance to the target and the size and type of shot.

The tracer cylinder has a disk-shaped top cap and a bottom container portion defining a cavity; the two parts are glued or welded together after the liquid has been injected into the cavity. A flat, disk-shaped piercing valve with a centrally-located point is positioned on top of the shot and below the tracer cylinder, with the end of the point adjacent to the bottom of the container portion of the tracer cylinder. The piercing valve has a diameter that is larger than that of the container, so that its edge extends past the outer circumference of the container.

Upon ignition of the shotgun shell and during acceleration of the tracer cylinder in the shotgun barrel, inertial forces push the point of the piercing valve into the bottom of the container portion of the tracer cylinder, creating a small, centrally-located opening in the bottom of the container. As the cylinder exits the barrel and is airborne, the edge of the piercing valve is affected by drag forces, which cause the displacement of the piercing valve, without affecting the accurate movement of the cylinder in front of the shot. The liquid inside the container is extracted through the opening created by the point of the piercing valve due to the difference in pressure between the liquid inside the cylinder and the low pressure air surrounding the sides and bottom portion of the cylinder created as the cylinder moves rapidly through the air. Upon exiting the cylinder through the opening in the bottom of the container, the miniature droplets of liquid create a mist or fog cloud, which is contained by the cone of air created at the rear of the cylinder, thereby increasing its density and making it visible for several seconds. This lasting fog cloud is visible to the eye in much the same way as a contrail or the tail of a comet, and it is easily seen by the shooter. The size of the opening created by the point on the piercing valve allows the manufacturer to adjust the amount of liquid being expelled from the cylinder, affecting the diameter, density and duration of the fog cloud created.

A metal ring-shaped weight can be affixed to the top cap of the tracer cylinder in order to increase its mass and to shift mechanical stressed on the cylinder during launch to the walls of the cylinder.

It is an object of the present invention to provide a tracer comprising a cylinder that contains a liquid which, after exiting the barrel of a shotgun, produces a mist or fog cloud that accurately traces the shot and is easily visible to the shooter for a sufficient amount of time so that it can be effectively used to help him or her with his or her shooting technique.

Another object of this invention is to provide the means by which the liquid contained in the cylinder can be released without negatively affecting the accuracy of the tracer.

Still another object of this invention is to provide a tracer comprising a cylinder filled with liquid which, after exiting the barrel, produces a fog cloud similar to that of a comet trail or contrail, the invention providing the means to adjust the diameter and length of the cylinder, as well as the density and duration of the tracing effect, depending on the gauge of the shotgun shell and the application with which it is to be used.

A further object of this invention is to provide a tracer for shotgun ammunition, the device being accurate and safe to use in single barrel, double barrel and semi-automatic shotguns, and, further, being structurally sound and able to withstand the high structural stresses associated with its application.

Further objects and advantages of this invention will become apparent from a consideration of the drawings and description, infra.

DESCRIPTION OF THE PREFERRED EMBODIMENTS

Figure 1:
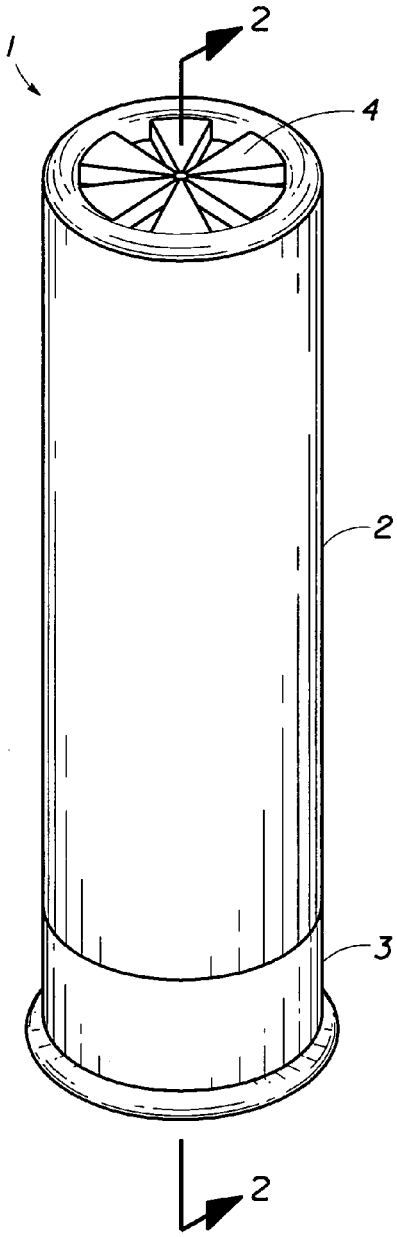
FIG. 1 is an isometric view of a shotgun shell containing the tracer cylinder of the present invention.

The present invention is designed to be used in a typical shotgun shell 1, which generally has a hull 2 with a metal base cap 3 and a crimped top 4, as shown in FIG. 1.

Figure 2:
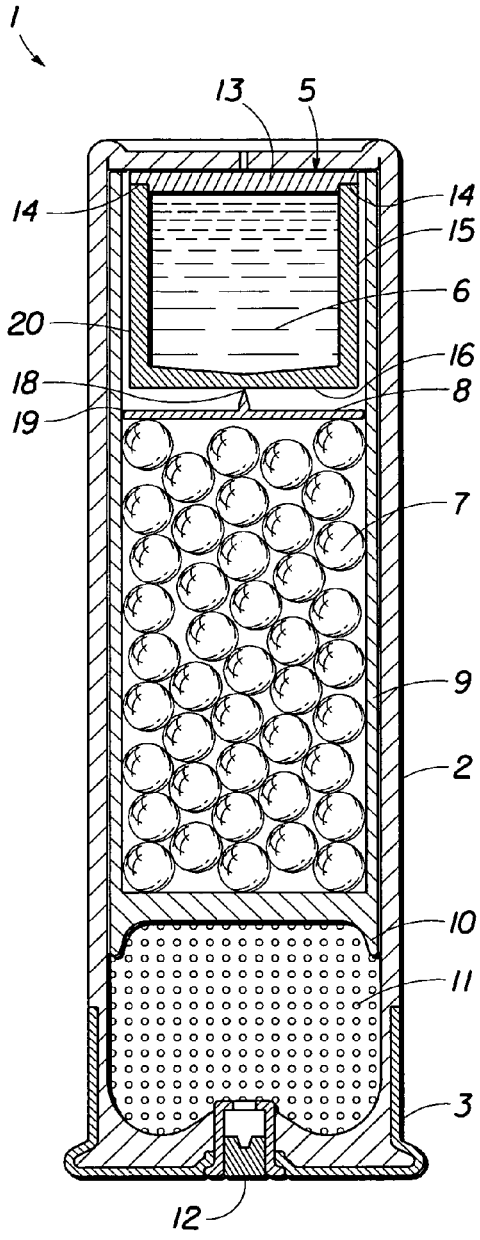
FIG. 2 is a sectional side view of the shell of FIG. 1, taken along line 2-2, showing the tracer cylinder strategically positioned in the shotgun shell, in front of the shot.

The sectional view in FIG. 2 shows the shotgun shell 1 with hull 2 and base cap 3, which has been assembled to hold the tracer cylinder 5 containing the tracer liquid 6, which is positioned in front of or on top of the shot pellets 7, separated therefrom and protected by a disk-shaped piercing valve 8 with a centrally-located perpendicular point 18, made of metal, hard plastic, or a similar rigid material. The shot pellets 7 are enclosed in a shot cup 9, which incorporates a gas seal 10 that is in direct contact with the propellant 11, which is next to the primer 12 at the lower end of the shotgun shell 1. The cylinder 5 consists of a top cap 13 with a radial indentation 14 and a container portion 15. The radial indentation 14, or step, provides more contact surface for glueing or welding the cap 13 to the container portion 15. It also permits easier and more accurate alignment of the two parts. The tracer liquid 6 used can be any one of a variety of liquid compounds, such as a vegetable oil (like olive oil), mineral oil, synthetic oil, paint, water, and aqueous gels, as well as known fogging liquids such as titanium tetrachloride ($TiCl_4$). When water or an aqueous gel is used, various dyes, pigments, and/or reflective particles are added in order to make the fog cloud more visible to the shooter. The bottom 16 of the container portion 15 is symmetrically positioned above the point 18 on the disk-shaped piercing valve 8 that has an outer edge 19 extending past the cylindrical sidewall 20 of the container portion 15.

In order to manually assemble the piercing valve 8 and tracer cylinder 5 into the shotgun shell 1, a user can insert the piercing valve 8, point-side up, above the shot pellets 7 and then drop the tracer cylinder 5, bottom-side down, on top of it. The height from which the tracer cylinder 5 is dropped must not be more than the height from which the tracer cylinder 5 has enough kinetic energy to be punctured by the point 18 on the piercing valve 8 during assembly. If an automated high volume manufacturing process is used, the same care must be taken to avoid puncturing the bottom 16 of the tracer cylinder 5 during the assembly process. Alternatively, the piercing valve 8 can be made as an integral component of the tracer cylinder 5 in the injection molding process used to form the top cap 13 and container 15. In this case, the piercing valve 8 could be attached by small plastic columns to the bottom 16 of the tracer cylinder 5, which guarantees that the point 18 on the piercing valve 8 is centrally positioned to the bottom 16 of the tracer cylinder 5. Connecting the piercing valve 8 and the tracer cylinder 5 allows the components to be assembled in the shotgun shell 1 as a single unit, which greatly benefits high volume processes. The position and number of such connecting columns will vary, but they should be located symmetrically. Upon firing of the shotgun shell 1, inertial forces would buckle and break the connecting columns, allowing the point 18 of the piercing valve 8 to puncture the bottom 16 of the tracer cylinder 5.

The space between the cylindrical sidewall 20 of the container portion 15 and the shot cup 9 is typically filled, either by using a shot cup 9 with petals having thickened upper portions, or by inserting a resilient spacer.

Figure 3:
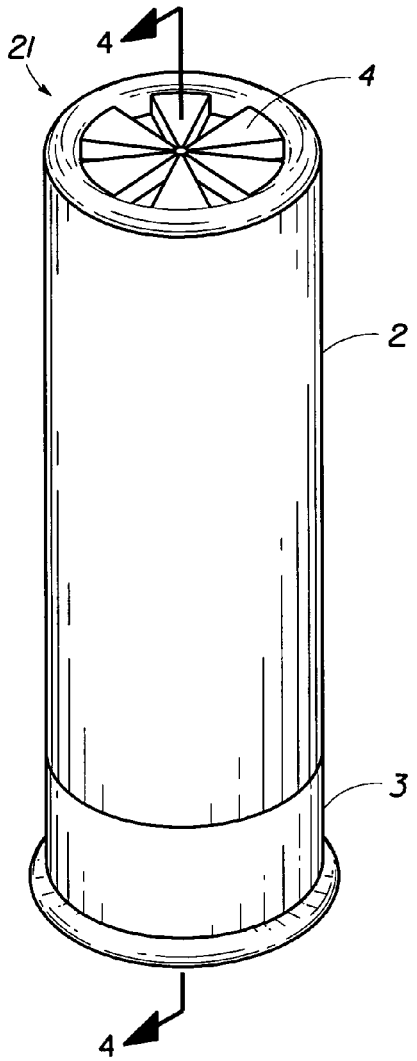
FIG. 3 is an isometric view of an alternative shotgun shell containing the tracer cylinder of the present invention.

Shown in FIG. 3 is an alternative shotgun shell 21, which generally has a hull 2 with a metal base cap 3 and a crimped top 4.

Figure 4:
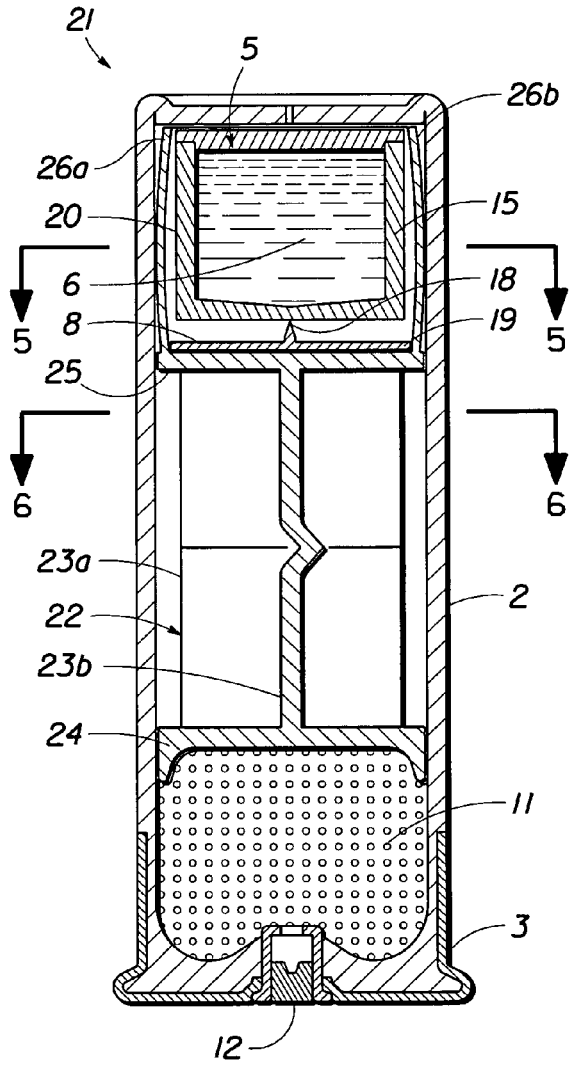
FIG. 4 is a sectional side view of the alternative shotgun shell containing the tracer cylinder illustrated in FIG. 3 taken along line 4-4.

As shown in FIG. 4, when used with the alternative shotgun shell 21, a disk-shaped piercing valve 8 with a centrally-located perpendicular point 18, made of metal, hard plastic, or a similar rigid material and a tracer cylinder 5, with container portion 15 holding tracer liquid 6, can be loaded into a conventional wad without any shot pellets, particularly when a shooter wishes to fire it merely as an indicator or reference. When this embodiment is assembled, a cylindrical wad 22, made from polypropylene, polyethylene, or another high-strength plastic, is placed inside the hull 2 of the shell 21 above the propellant 11 inside base cap 2. The wad 22 is typically formed with shock-absorbing compression columns 23*a*, 23*b*, (23*c*, 23*d*) and has a gas seal 24 formed in its lower end. The tracer cylinder 5 is then placed into the wad shot holder 25, inside the petals 26*a*, 26*b*, (26*c*, 26*d*), which surround the sidewall 20 and cushion the tracer cylinder 5 during ignition, and which open and fall away when the tracer cylinder 5 is in flight. Like the tracer cylinder 5 shown in FIG. 2, the bottom 16 of the container portion 15 is symmetrically positioned above the point 18 on the disk-shaped piercing valve 8. Assembly of the piercing valve 8 and the cylinder 5 into the shell 21 are performed as described supra, in the description related to FIG. 2.

Figure 5:
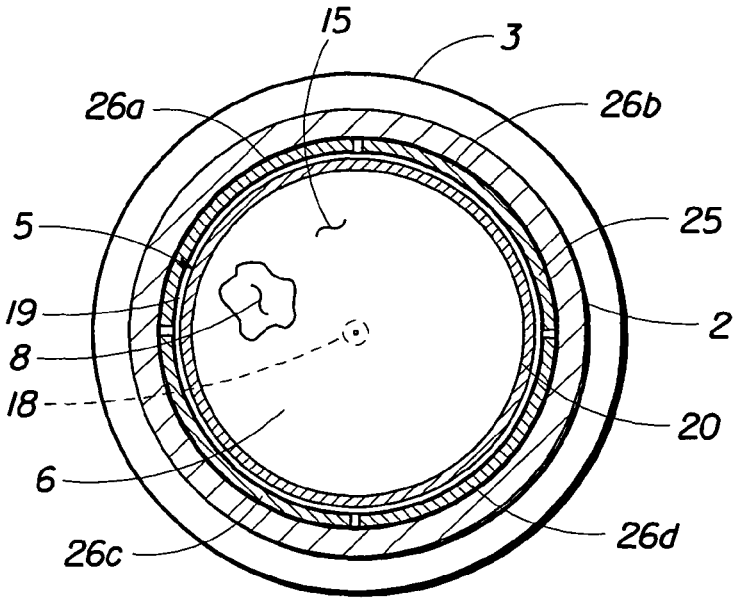
FIG. 5 is an enlarged cross-sectional view of the top of the alternative shotgun shell containing the tracer cylinder illustrated in FIG. 4 taken along line 5-5.

FIG. 5 shows the sidewall 20 of the container 15 inside the petals 26*a*, 26*b*, 26*c*, 26*d* of the shot holder 25 inside the hull 2. The container portion 15, which has been filled with tracer liquid 6, has been positioned above the point (18) on the disk-shaped piercing valve 8, whose outer edge 19 extends past the sidewall 20 of the container portion 15.

Figure 6:
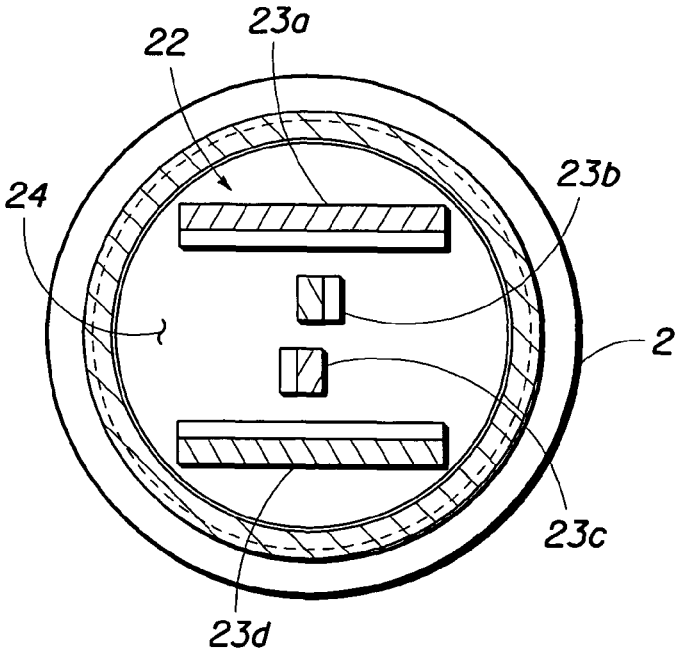
FIG. 6 is an enlarged cross-sectional view of wad inside of the alternative shotgun shell containing the tracer cylinder illustrated in FIG. 4 taken along line 6-6.

FIG. 6 shows the shock-absorbing compression columns 23*a*, 23*b*, 23*c*, 23*d* of the wad 22 inside the hull 2, as well as the gas seal 24.

Figure 7:
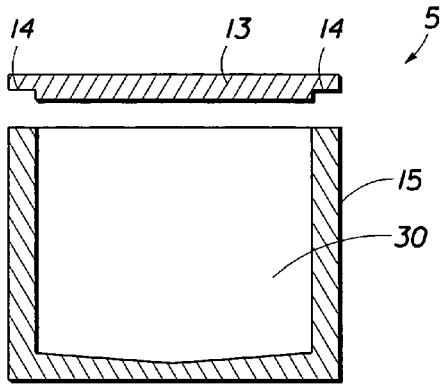
FIG. 7 is a sectional side view of an empty tracer cylinder.

FIG. 7 shows a sectional view of an empty tracer cylinder 5, consisting of a disk-shaped top cap 13 with radial indentation 14 and a cylindrical container portion 15, which will be glued or welded together, leaving a cavity 30. Both parts of the tracer cylinder 5 are typically made from a high-strength plastic, such as polypropylene or polyethylene, or from nylon, using standard high volume processes, including injection molding and high-speed screw machines. Alternatively, the top cap 13 and container portion 15 can be made from a metal, such as brass, aluminum, copper or steel, using stamping and deep drawing techniques. After the tracer liquid 6 has been injected into the cavity 30, the top cap 13 and the container portion 15 will be joined together. The joining process can be performed in a number of ways, such as using a combination of specialized high strength glues and accelerators, soldering, or welding, including ultrasonic welding.

Figure 8:
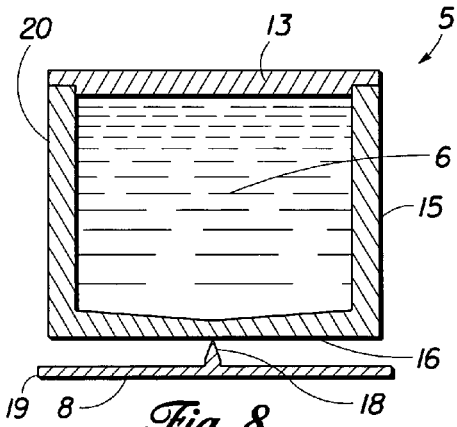
FIG. 8 is a sectional side view of a tracer cylinder containing tracer liquid, which is positioned above a disk-shaped piercing valve.

FIG. 8 is a sectional view of the tracer cylinder 5 after it has been filled with tracer liquid 6. The tracer liquid 6 has been loaded into the cylinder 5 at atmospheric pressure or at a slightly higher pressure to aid in the flow of the tracer liquid 6 out of the tracer cylinder 5, depending on the type of shell 1 used and the distance to the target. The bottom 16 of the filled tracer cylinder 5 will be positioned above a disk-shaped piercing valve 8, which generally has a diameter that is slightly larger than the diameter of the cylinder 5 so that its outer edge 19 extends past the sidewall 20 of the container portion 15. The disk-shaped piercing valve 8 can be made from metal, hard plastic, or a similar rigid material, using standard injection molding and stamping processes. The disk-shaped piercing valve 8 has a centrally-located cone-shaped point 18, which is somewhat longer that the thickness of the bottom 16 of the container portion 15 so that the point 18 can properly puncture the bottom 16. The diameter of the point 18 must be small enough to form an opening that permits proper mystification of the tracer liquid 6 during flight (see next paragraph).

Figure 9:
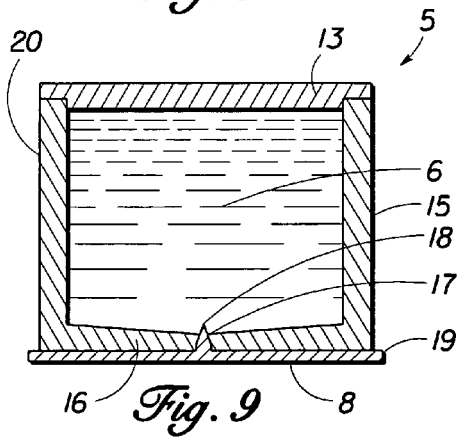
FIG. 9 is a sectional side view of a tracer cylinder containing tracer liquid, after the bottom of the cylinder has been punctured by the disk-shaped piercing valve.

FIG. 9 shows a sectional view of the tracer cylinder 5 after the point 18 of the disk-shaped piercing valve 8 has punctured the bottom 16 of the container portion 15 of the tracer cylinder 5, forming opening 17 and coming in contact with the tracer liquid 6. The size of the opening 17 formed will range from approximately 0.5% to 5% of the diameter of the cylinder 5, depending on the speed at which the cylinder 5 will travel and the type and viscosity of the liquid 6 used as a tracer. The opening 17 needs to be small enough to extract minute droplets of liquid 6 in order to create a mist or fog cloud upon exiting the cylinder 5, yet large enough to allow the liquid 6 to flow out of the cylinder 5 due to the difference in pressure exerted on the liquid 6 inside the cylinder 5 and the low pressure air surrounding the sides and bottom portion of the cylinder 5. As can been seen in the figure, the diameter of the piercing valve 8 is greater than the outer diameter of the cylinder 5, with outer edge 19 extending beyond the sidewall 20 of the cylinder 5.

Figure 10:
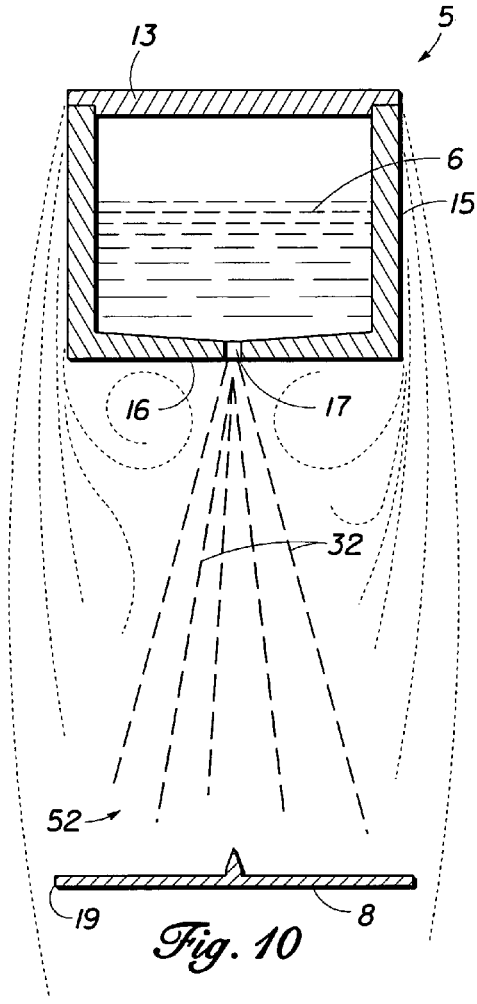
FIG. 10 shows a sectional side view of an airborne tracer cylinder after the shell has been fired from a shotgun, the disk-shaped piercing valve having fallen away due to air drag forces, the liquid being released into the atmosphere by the vacuum created in the air surrounding the tracer cylinder.

FIG. 10 shows a sectional view of the tracer cylinder 5 of FIG. 9 after the shotgun shell (1 or 21) has been fired and the cylinder 5 has left the barrel. The disk-shaped piercing valve 8 has been detached due to strong air drag forces exerted on its edge 19 after the tracer cylinder 5 is airborne. Because the disk-shaped piercing valve 8 was symmetrically positioned on the bottom 16 of the container portion 15, it separates without affecting the accuracy of the device. After the piercing valve 8 has been removed, the tracer liquid 6 in the tracer cylinder 5 is released into the atmosphere through the opening 17 in the bottom 16 of the container portion 15 due to the low-pressure area surrounding the cylinder 5 in flight.

The tracer liquid 6 exits through the small opening 17 in the form of small droplets 32, which create a fog mist or cloud 52 that is highly visible to the shooter (i.e., the sunlight reflects off the increased surface area of the droplets). Because only small droplets 32 are released from the cylinder 5, the amount of tracer liquid 6 the cylinder 5 must hold can be very small and, therefore, the device is extremely efficient. Because the tracer liquid 6 exits the cylinder 5 through the opening 17 in the bottom 16 of the container 15, the fog cloud created is contained within the cone of air created by the air stream at the back of the cylinder 5, thereby increasing its density and making it visible for several seconds. This long-lasting fog cloud mimics the tail of a comet and is easily seen by the shooter.

Figure 11:
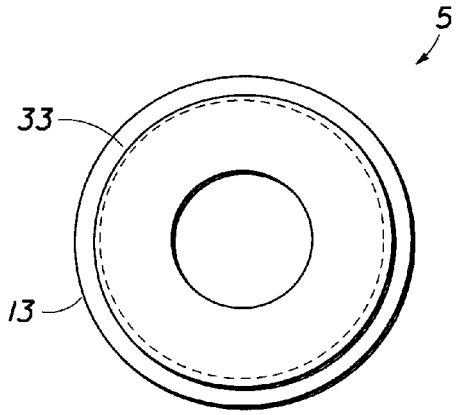
FIG. 11 is a top view of an alternate embodiment of the present invention, showing a ring-shaped weight affixed to the top cap of the tracer cylinder.

As shown in FIG. 11, tracer cylinder 5 of the present invention can be made with a ring-shaped weight 33 affixed to its top cap 13. The main purpose of the ring-shaped weight 33 is to increase the mass of the cylinder 5 during launch. The geometry of the ring-shaped weight 33 shifts the mechanical stresses on the cylinder 5 during launch from its nose to its cylindrical walls. The ring-shaped weight 33 is typically be made from metal, such as aluminum, copper, brass, bronze, lead, or steel. Its outer diameter is smaller than the outer diameter of the cylinder 5 to avoid direct contact with the gun barrel. The diameter of the ring-shaped weight 33, its thickness, and the size of the central opening will vary, depending on the material used to make the ring-shaped weight 33 and the cylinder's 5 range or application.

Figure 12A:
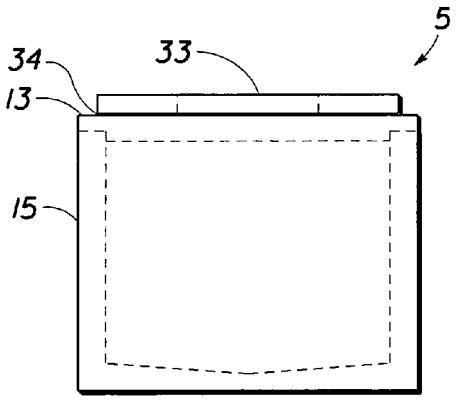
FIG. 12 is a side view of the alternate embodiment, showing the ring-shaped washer affixed to the top cap of the tracer cylinder.
Figure 12B:
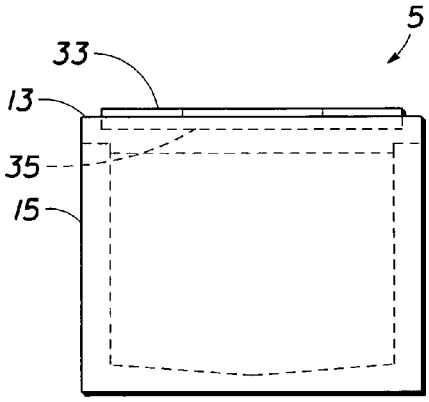

FIGS. 12A and 12B are side views of the tracer cylinder 5 shown in FIG. 11, showing the ring-shaped weight 33 affixed to the top cap 13 of the tracer cylinder 5 with a layer 34 of adhesive or high-strength glue, or by ultrasonic welding. The weight 33 can be made from a metal, such as lead, aluminum, brass, steel, copper, or bronze.

In FIG. 12A, the ring-shaped weight 33 has simply been affixed onto the upper side of the top cap 13. As shown in FIG. 12B, the ring-shaped weight 33 can be affixed or snap-fitted to the top cap 13 inside a radial indentation 35 formed in the top cap 13 or it can be integrated into the cap 13 during injection molding of the cap 13. The radial indentation 35 adds mechanical interference and increases the surface area for the glue, if used.

FIGS. 13A-13D show the typical movement of the tracer cylinder 5 before and after ignition of the shotgun shell 1.

Figure 13A:
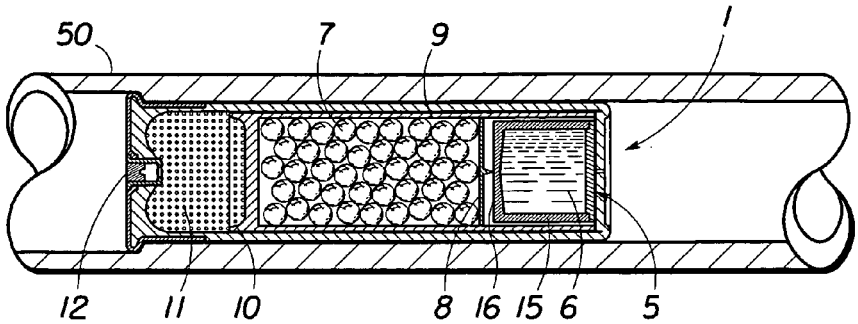
FIGS. 13A through 13D are sequential sectional side views of the tracer cylinder before and after ignition of the shell, showing the piercing of the tracer cylinder, the detachment of the valve, and the release of the liquid from the tracer cylinder.

In FIG. 13A, the shotgun shell 1, containing a shot cup 9 with shot pellets 7, a disk-shaped piercing valve 8, and a cylinder 5 holding tracer liquid 6, has been loaded into the shotgun barrel 50. The bottom 16 of the container portion 15 of the cylinder 5 has been positioned in front of the piercing valve 8. The primer 12 ignites the propellant 11, and gasses expand into the gas seal cavity 10.

Figure 13B:
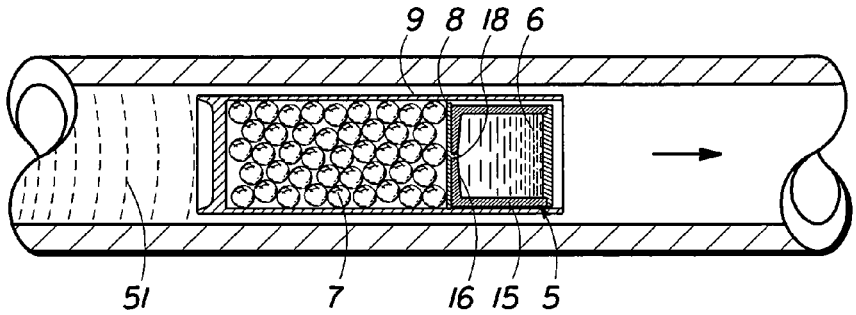

In FIG. 13B, the expanding gases 51 of ignition propel the shot cup 9 with shot pellets 7 and the cylinder 5 holding the tracer liquid 6 through the shotgun barrel 50. The forces of ignition have caused the point 18 on the piercing valve 8 to puncture the bottom 16 of the container portion 15 of the cylinder 5 holding the tracer liquid 6.

Figure 13C:
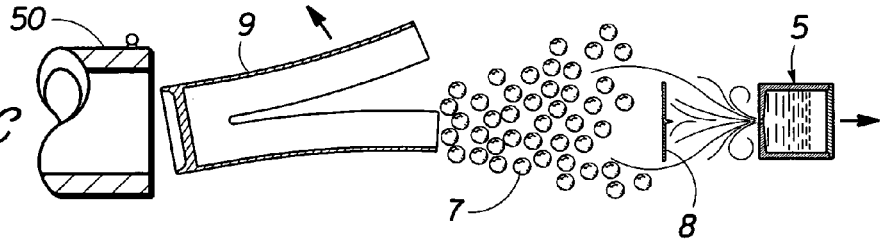

In FIG. 13C, after leaving the shotgun barrel 50, the shot cup 9 has flipped out of the way of the scattering shot pellets 7. The disk-shaped piercing valve 8 has been detached, and the cylinder 5 continues to travel in front of the pattern of shot pellets 7.

Figure 13D:
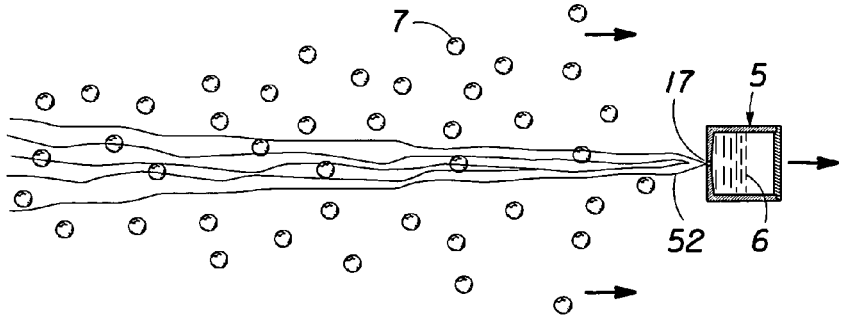

As shown in FIG. 13D, the tracer liquid 6 is being drawn from the opening 17 in the bottom of the cylinder 5, creating a fog cloud 52, which coincides with the pattern of shot pellets 7.

Figure 14:
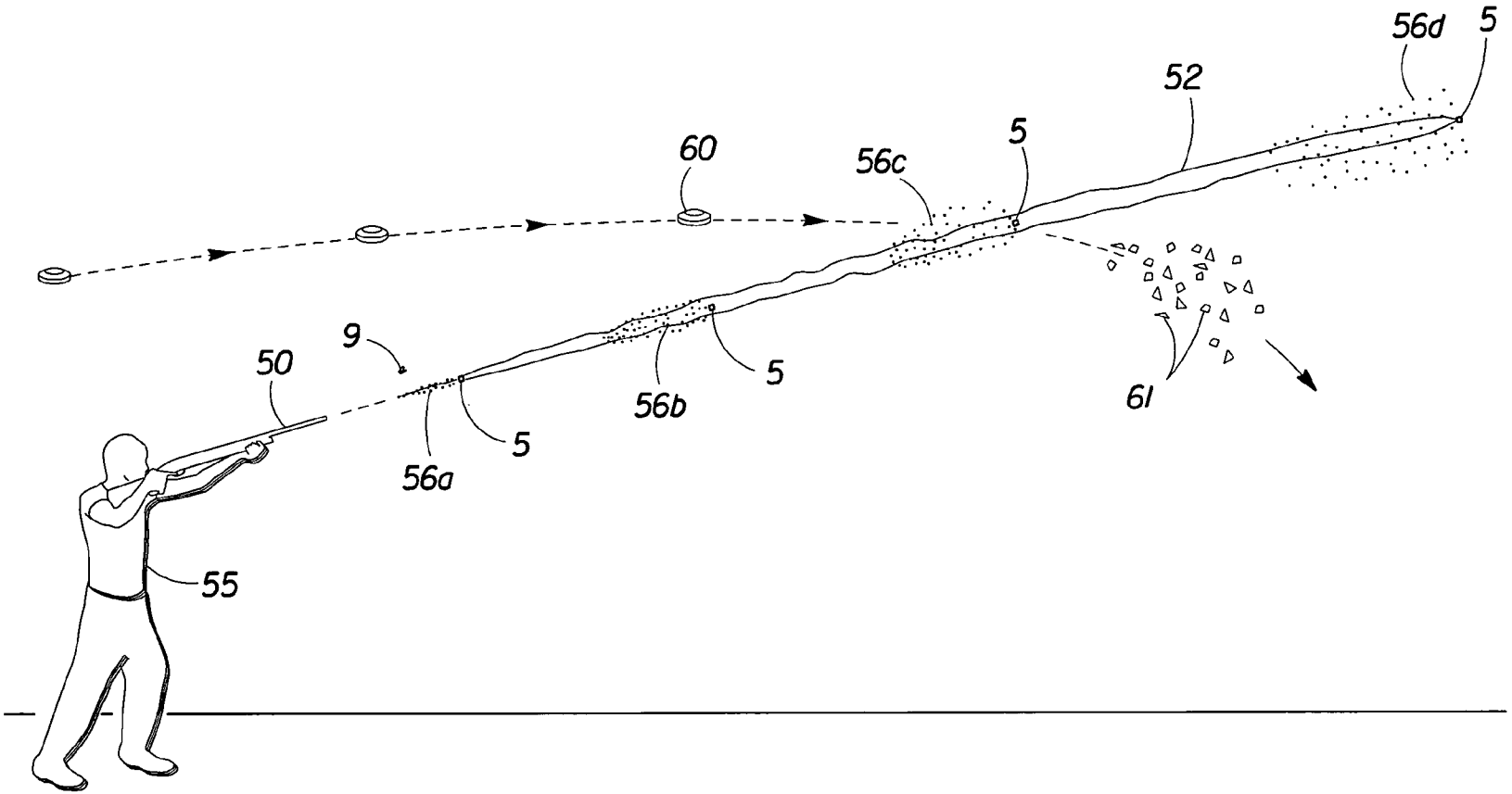
FIG. 14 is a representational view of a shooter using the tracer cylinder of the present invention while shooting at a clay target.

FIG. 14 shows a shooter 55 using the tracer cylinder 5 of the present invention. The shooter 55 has loaded his shotgun barrel 50 with the shotgun shell (1 or 21), as he would load any other ammunition. The shooter 55 has aimed at the clay target 60 and has fired. The cylinder 5 has left the shotgun barrel 50, in front of the shot string 56*a*, 56*b*, 56*c*, 56*d*, leaving a fog cloud 52 streaming through the center of the expanding pattern of shot pellets in the shot string 56. The shot cup 9 has flipped out of the way. If the shooter 55 hits the clay target 60, it breaks into pieces 61. If he misses the clay target 60, the shooter 55 would correct his lead or aiming point, according to the relative position of the fog cloud to the clay target 60.

The information in the disclosure and description of the invention itself are illustrative only of the application of the principles of the present invention. Modifications and alternative embodiments may be devised by those skilled in the art without departing from the spirit and scope of the present invention. For instance, the tracer cylinder can be enclosed in an annular cylinder made of plastic, cardboard or paper, to accommodate the use and production of a standardized tracer device that can be used in different shotgun gauges. Further, the bottom 16 of the container portion 15 can be made with a centrally-located indentation or notch that would engage the point 18 of the disk-shaped piercing valve 8 and facilitate the puncturing of the bottom 16 of the container portion 15 during launch of the shell 1.

We claim:

1. A combination of a tracer cylinder and a piercing valve, the combination for use with a shotgun shell having a lower end and an upper end, and further having primer, propellant and a shot cup, the primer and propellant being contained inside the lower end of the shotgun shell, the combination designed for placement inside the upper end of the shot cup, the tracer cylinder comprising a top cap and a container having a sidewall and a bottom, the container holding a liquid material, the piercing valve having an outer edge and further having a perpendicular point positioned adjacent to the bottom of the container, ignition of the propellant forcing the point of the piercing valve to puncture the bottom of the container forming a small opening plugged by the piercing valve, the piercing valve being detached from the bottom of the container by drag forces exerted on the outer edge after the tracer cylinder leaves a shotgun barrel and becomes airborne, with pressure differential causing the liquid material to be extracted from the container through the opening in the bottom of the container in the form of small droplets, creating a mist or fog cloud.

2. The tracer cylinder of claim 1 wherein the container is made from a material selected from the group consisting of polypropylene, polyethylene, nylon, brass, aluminum, copper and steel.

3. The tracer cylinder of claim 1 wherein the liquid material is selected from the group consisting of vegetable oil, mineral oil, synthetic oil, paint, and titanium tetrachloride ($TiCl_4$).

4. The tracer cylinder of claim 1 wherein the liquid material is selected from the group consisting of water and an aqueous gel, and an additive selected from the group consisting of dyes, pigments, and reflective particles is added to the liquid material.

5. The tracer cylinder of claim 1 wherein the sidewall has a certain circumference and the piercing valve is a flat disk having a slightly larger circumference than the circumference of the sidewall.

6. The tracer cylinder of claim 1 wherein the top cap has a ring-shaped weight affixed thereto.

7. The tracer cylinder of claim 6 wherein the ring-shaped weight is made from a metal selected from the group consisting of lead, aluminum, brass, steel, copper, and bronze.

8. The tracer cylinder of claim 1 wherein the cylinder has a height and a diameter, and the height of the cylinder is equal to or greater than the diameter of the cylinder.

9. The tracer cylinder of claim 1 wherein the small opening has a diameter ranging from 0.5% to 5% of the diameter of the cylinder.

10. A shotgun shell with a liquid mist tracer for making shot pellets' trajectory visible to a shooter comprising:

(a) a hollow shotgun shell having a lower end and an upper end;

(b) a base with primer for ignition located inside the lower end of the shotgun shell;

(c) propellant positioned proximate to the primer inside the lower end of the shotgun shell;

(d) a shot cup partially filled with shot pellets;

(e) a disk-shaped piercing valve with a perpendicular point positioned above the shot pellets held in the shot cup;

(f) a tracer cylinder positioned inside the upper end of the shot cup proximate to the point of the piercing valve, the tracer cylinder comprising a cap and a container having a bottom, the point on the piercing valve capable of puncturing a small opening in the bottom of the container, the container holding a liquid material capable of creating a mist or fog cloud when released into the atmosphere as the liquid is extracted from the container through the opening in the bottom of the container after the piercing valve has been removed by drag forces.

11. The shotgun shell of claim 10 wherein the cap of the tracer cylinder further comprises a ring-shaped weight affixed thereto.

12. The shotgun shell of claim 11 wherein the ring-shaped weight is made from a metal selected from the group consisting of lead, aluminum, brass, steel, copper, and bronze.

13. A shotgun shell holding no shot, the shotgun shell having a liquid mist tracer for making the tracer's trajectory visible to a shooter comprising:

(a) a hollow shotgun shell having a lower end and an upper end;

(b) a base with primer for ignition located inside the lower end of the shotgun shell;

(c) propellant positioned proximate to the primer inside the lower end of the shotgun shell;

(d) a cylindrical wad positioned proximate to the propellant, the wad having a shot holder;

(e) a disk-shaped piercing valve with a perpendicular point positioned inside the shot cup; and (f) a tracer cylinder positioned in the shot holder inside the upper end of the shotgun shell proximate to the point of the piercing valve, the tracer cylinder comprising a cap and container having a bottom, the point on the piercing valve capable of puncturing a small opening in the bottom of the container, the container holding a liquid material capable of creating a mist or fog cloud when released into the atmosphere as the liquid is extracted from the container through the opening in the bottom of the container after the valve has been removed by drag forces.

14. The shotgun shell of claim 13 wherein the cap of the tracer cylinder further comprises a ring-shaped weight affixed thereto.

15. The shotgun shell of claim 14 wherein the ring-shaped weight is made from a metal selected from the group consisting of lead, aluminum, brass, steel, copper, and bronze.

* * * * *